US009988775B1

(12) United States Patent
Garber

(10) Patent No.: US 9,988,775 B1
(45) Date of Patent: Jun. 5, 2018

(54) CONCRETE I-BEAM FOR BRIDGE CONSTRUCTION

(71) Applicant: David Garber, Miami, FL (US)

(72) Inventor: David Garber, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days. days.

(21) Appl. No.: 15/830,656

(22) Filed: Dec. 4, 2017

(51) Int. Cl.

| | |
|---|---|
| ***E04B 5/06*** | (2006.01) |
| ***E01D 2/02*** | (2006.01) |
| ***E01D 21/00*** | (2006.01) |
| ***E04G 13/04*** | (2006.01) |
| *E01D 101/26* | (2006.01) |

(52) U.S. Cl.
CPC ..... *E01D 2/02* (2013.01); *E01D 21/00* (2013.01); *E04B 5/06* (2013.01); *E04G 13/04* (2013.01); *E01D 2101/26* (2013.01)

(58) Field of Classification Search
CPC .... E01D 2/00; E01D 2/02; E01D 2/04; E01D 2101/26; E04B 5/04; E04B 5/06; E04C 3/20; E04G 13/04
USPC ..... 14/74.5, 77.1; 52/416, 419, 429, 431, 52/433, 437, 649.1, 650.1, 831, 837
See application file for complete search history.

(56) References Cited

U.S. PATENT DOCUMENTS

| | | | | | |
|---|---|---|---|---|---|
| 83,196 | A * | 10/1868 | Montgomery | 14/74.5 | |
| 785,539 | A * | 3/1905 | Benner | 52/437 | |
| 1,034,770 | A * | 8/1912 | Emerson | E04B 2/28 | 52/429 |
| 1,720,693 | A * | 7/1929 | Sahlberg | E04C 3/29 | 52/433 |
| 1,887,875 | A * | 11/1932 | Nelson | E04B 5/265 | 52/433 |
| 2,184,137 | A * | 12/1939 | Brewer | E04B 5/08 | 14/73 |
| 5,655,243 | A * | 8/1997 | Kim | E01D 21/00 | 14/74.5 |
| 8,381,485 | B2 * | 2/2013 | Platt | B28B 7/164 | 14/74.5 |
| 8,689,383 | B2 * | 4/2014 | Han | E01D 19/02 | 14/74.5 |
| 9,249,546 | B2 * | 2/2016 | Han | E01D 2/02 | |
| 9,890,505 | B2 * | 2/2018 | Shamsai | E01D 2/02 | |

FOREIGN PATENT DOCUMENTS

| | | | |
|---|---|---|---|
| KR | 1591804 | B1 * | 2/2016 |
| KR | 1618085 | B1 * | 5/2016 |
| KR | 1797969 | B1 * | 11/2017 |

* cited by examiner

*Primary Examiner* — Gary S Hartmann
(74) *Attorney, Agent, or Firm* — Saliwanchik, Lloyd & Eisenschenk

(57) ABSTRACT

A beam used for construction, particularly of short- to mid-span bridges. A beam can include flanges extending from a web that are joined to flanges of another beam. When joined two beams form an open internal void. The beams can be manufactured from concrete and include an embedded reinforcement cage. Manufacture of the beams utilizes a formwork that can be filled in a single pour.

9 Claims, 9 Drawing Sheets

CONCRETE I-BEAM FOR BRIDGE CONSTRUCTION

BACKGROUND OF INVENTION

Pre-stressed concrete box-beams have been used since the 1950's to build short and medium span bridges. It is estimated that there are approximately 54,000 box beam bridges in service in the United States. Box-beams are popular because they can be used in multiple ways to quickly and safely construct bridges.

Box beams are typically manufactured by casting reinforced concrete around a foam core in a mold or formwork. Rebar is used to build a reinforcing "cage" around the foam core prior to pouring the concrete. The bottom part of the cage is placed first and then a layer of concrete is poured. The foam core is placed on the layer of concrete and the top of the cage is built up around the foam core. Concrete is poured to surround the foam core and the rest of the cage.

Because the foam core fills the central space of the box beam and is surrounded by concrete after the pour, it is not possible to do a post-cast inspection of the interior of the box-beam. It is also possible for the foam core to shift during the pour causing inconsistencies in concrete thickness in the webs and flanges, which change the strength of the beam. Further, the time involved in constructing and pouring the concrete in two stages can result in formation of a "cold joint" between the bottom and top parts of the beam, which are poured in two stages. A cold joint can form when a fluid concrete is poured over set or semi-set concrete. The interface where two different phases of concrete meet can form a cold joint, which can be weaker than other more consolidated areas of the concrete mass.

During construction, box beams are placed adjacent to one another with a small gap between called a shear key. The shear key can be filled with a cementitious grout material. Once the box-beams are set and grouted, a transverse post-tensioning (TPT) arrangement is used to apply force across the box-beams. This is followed by laying a 3" to 6" reinforced deck slab over the box-beams or an asphalt overlay for low-traffic bridges. When the box-beams, grouted-shear keys, TPT, and the deck slab are properly integrated, a completed bridge can perform as a monolithic structure.

It is normal for cracks to form in grout material between the box-beams. The box-beams can also develop small fractures or cracks. Water and other materials that seep into the cracks can be absorbed by the grout and the foam. This creates an internal environment that is moist and, over time, promotes degradation of the grout material and the box beam. Because the internal void cannot be inspected, the rate of degradation cannot be easily monitored.

Ultra-high performance concrete (UHPC) has become an important structural material. UHPC benefits from being a "minimum defect" material. That is, UHPC is a material that is less susceptible to the formation of defects such as micro-cracks and interconnected pores, and exhibits a maximum packing density. Several types of UHPC have been developed in different countries and by different manufacturers. The four main types of UHPC are compact reinforced composites (CRC), multi-scale cement composite (MSCC), and reactive powder cement (RPC). RPC is the most commonly available UHPC and one such product is currently marketed under the name Ductual® by Lafarge, Bouygues and Rhodia.

There is a need for a reinforced concrete beam that can be cast in a single concrete pour that still has an internal void to be used for inspecting the beam surfaces after casting. The ability to use UHPC as a grout material between the beams would also be an advantage.

BRIEF SUMMARY

The subject invention provides devices and methods that address the problems associated with standard box-beams and their construction. The subject invention provides a pre-cast concrete beam with an imbedded reinforcement cage. The reinforcement cage can be entirely assembled in a formwork prior to addition of concrete, which can be done in a single pour. The beams can be used in pairs to form a structure similar to a box beam. Advantageously, a foam core is not required, allowing for post-cast inspection of the interior void surface of the final beam structure.

Embodiments of a beam of the subject invention have an "I" shape or similar shape, where there is a web column with two top flanges and two bottom flanges. An alternative embodiment has an "i" (or inverted-"T") shape, with a web and two bottom flanges. In use, two beams can be placed side by side, with adjacent flanges. The flanges can have irregular faces that allow a grout material to be intermolded therebetween to facilitate holding the beams together and foiiiiing a joint.

When joined, two I-shaped beams can form a complete box-beam type of structure, with an open interior void available for post-cast inspection. Alternatively, when two inverted T-shaped beams are joined, precast panels can be placed on the webs between two beams to form a box beam type of structure, which also has an open interior void available for post-cast inspection. Grout material can be used to fill the space between the web and pre-cast panels.

UHPC has been used in bridge construction as a grout material. UHPC can also be advantageously used to connect beams of the subject invention. The use of UHPC as a grout material to connect both the top and bottom flanges between two beams can minimize the risk of cracking in the deck where the flanges meet to form a joint.

A sectional formwork can be used to construct a beam without the need for a foam core. This can provide improved accuracy and precision of the beam dimensions. It also allows the reinforcement cage to be built entirely within the form before pouring the concrete into the formwork.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention.

DETAILED DISCLOSURE

Figure 1:
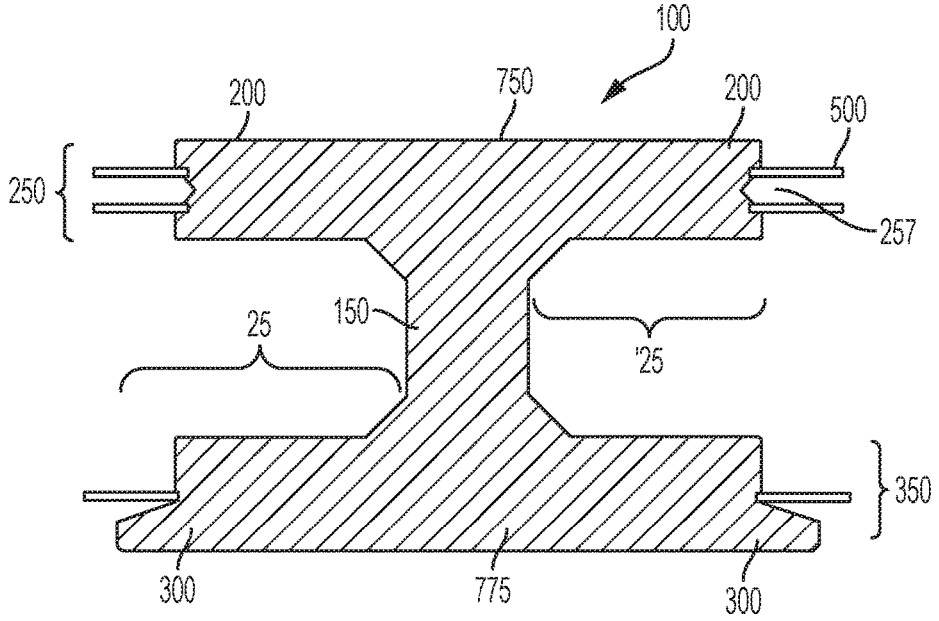
FIG. 1 shows an embodiment of a beam, according to the subject invention, having top flanges and bottom flanges.

The subject invention provides methods and devices for casting and joining beams that can be used to build structures, particularly short- and mid-span bridges. More specifically, the subject invention provides one or more beam embodiments with flanges. The beams can be placed adjacent to each other and joined at the flanges to form a superstructure. Alternatively, other structures or components, such as pre-cast panels, can be placed on, and joined to, the beams to create a superstructure.

The structure of the joined beams can be used similarly to standard box beams. Advantageously, the joined beams can provide an interior void, like a box beam, but that is not filled with a foam core and allows for full post-cast inspection, unlike standard box beams. Grout material, such as, for example, ultra-high performance concrete (UHPC) can be used to join the beams to minimize cracking and separation.

The subject invention is particularly useful in the field of bridge construction, in particular short- to mid-span bridges. While the subject application describes, and many of the terms herein relate to, a use for bridge construction, other uses apparent to a person with skill in the art and having benefit of the subject disclosure are contemplated to be within the scope of the present invention.

Reference is also made throughout the application to the "proximal end" or "proximal direction" and "distal end" or "distal direction." As used herein, the proximal end or proximal direction is that end that is directed upwards in a structure or that end against which force or weight is applied, particularly when used in bridge construction. Conversely, the distal end or distal direction of the device is that end which is directed downward or forms the bottom side. For example, a modular reinforcement cage can be built from the distal end.

The present invention is more particularly described in the following examples that are intended to be illustrative only because numerous modifications and variations therein will be apparent to those skilled in the art. As used in the specification and in the claims, the singular for "a," "an" and "the" include plural referents unless the context clearly dictates otherwise.

Reference will be made to the attached Figures on which the same reference numerals are used throughout to indicate the same or similar components. With reference to the attached Figures, which show certain embodiments of the subject invention, it can be seen that the subject invention pertains to a beam 100 and methods for manufacturing a beam. One embodiment of a beam includes a web 150 with opposing top flanges 200 that protrude from the web and opposing bottom flanges 300 that protrude from the web. In one embodiment, the top flange and bottom flanges are perpendicular to the web. Other embodiments of a beam have a web with only bottom flanges. A reinforcement cage 500 and longitudinal pre-stressing strands 575 can be imbedded in the beam to support the web and the bottom flanges and/or top flanges and give the beam its required strength.

The method of casting a beam can utilize a formwork 600 that allows the entire reinforcement cage to be placed or built therein and secured, so that one continuous concrete pour can be made to fill the formwork and surround the reinforcement cage. Each of these general components and steps can have one or more sub-components or sub-steps, which will be discussed in detail below.

Figure 2:
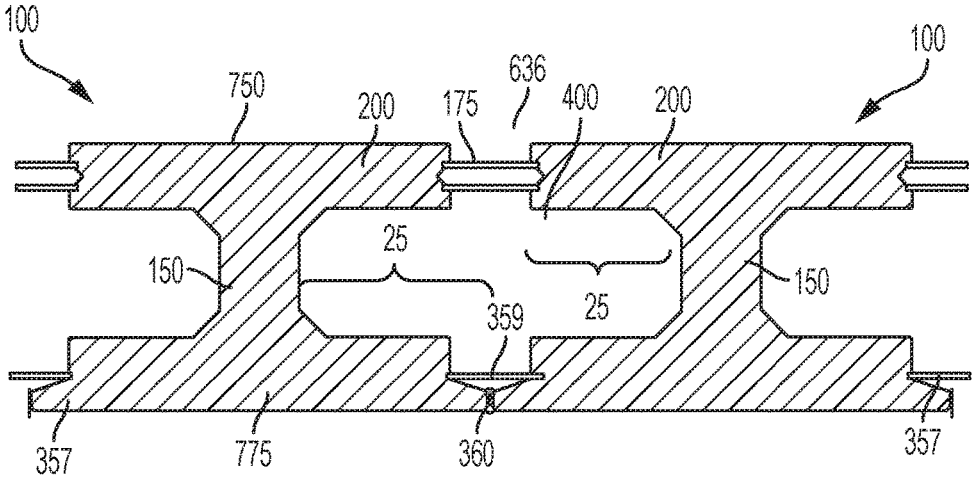
FIG. 2 shows two beams, according to the subject invention, positioned side-by-side with adjacent flanges.
Figure 9:
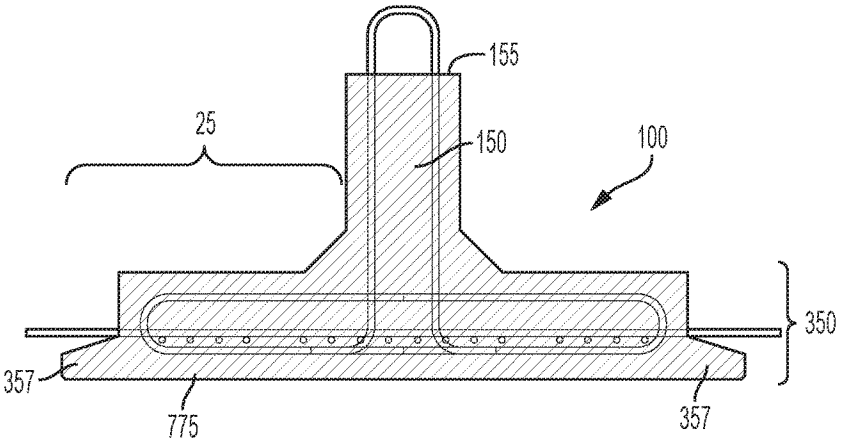
FIG. 9 shows an embodiment of a beam, according to the subject invention, having bottom flanges.
Figure 10:
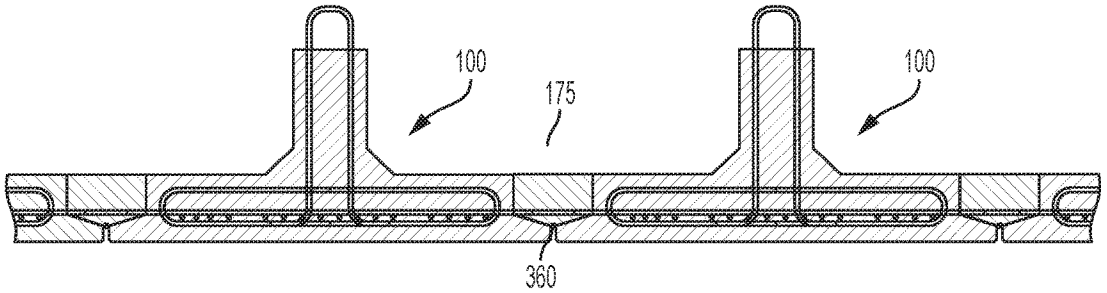
FIG. 10 shows two beams, as seen in FIG. 9, positioned side-by-side with adjacent bottom flanges.
Figure 12A:
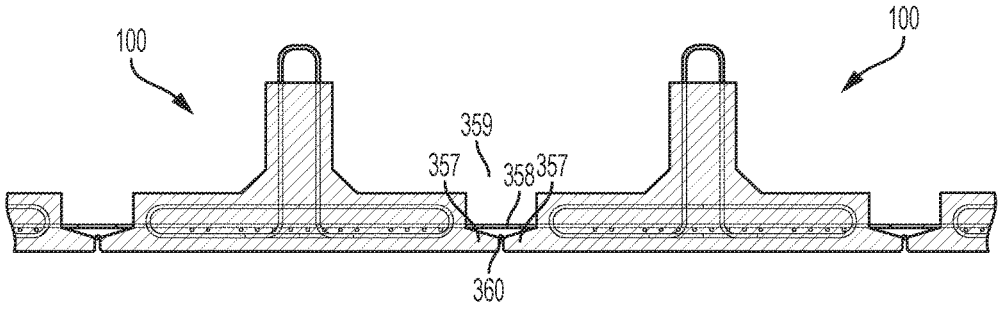
FIGS. 12A through 12D illustrate a method for joining two beams having only bottom flanges, according to the subject invention.
Figure 12B:
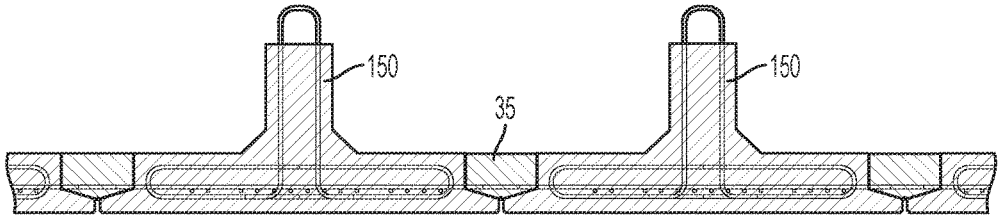
Figure 12C:
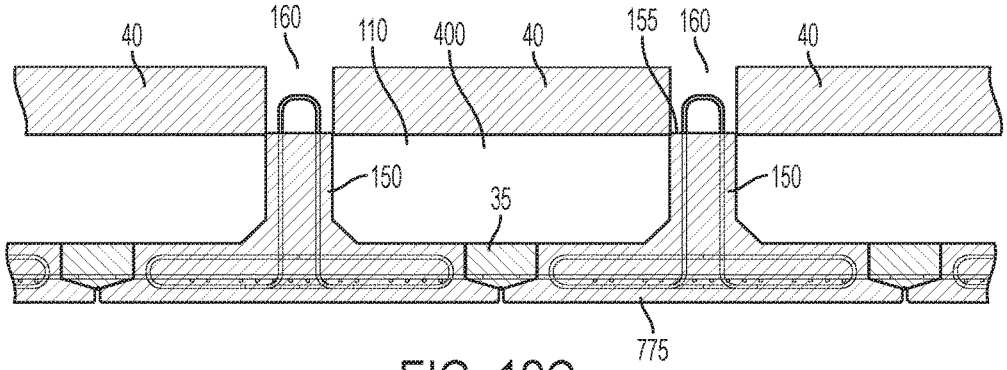
Figure 12D:
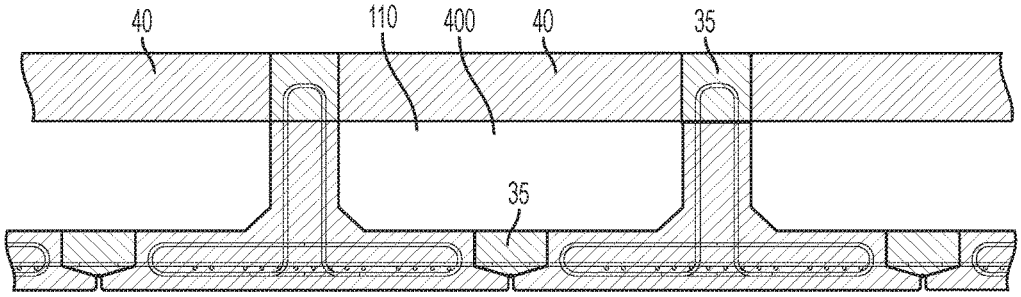

Standard box beams placed side-by-side have a space between them called a "shear key" 55. The standard box beam formwork can be designed to create a shear key when the box beam concrete is poured. FIGS. 3A-3E illustrate a formwork having indentations 56 that can form a shear key in the sides of a standard box beam. During the construction of a structure, such as, by way of example, a short- or mid-span bridge, the shear key is filled with a grout material 35, to transfer vertical shear and bending stresses between the box beams. For example, magnesium ammonium phosphate grout mixed with pea gravel, polymer cements, fiber-reinforced cements, and epoxy-based grouts can be used Conversely a beam 100 of the subject invention can be used in pairs to create an alternative to a standard box beam. Unlike a typical box beam, a beam of the subject invention when joined in pairs provides an open internal void 400. FIG. 1 illustrates one embodiment of a beam of the subject invention that has top flanges and bottom flanges. FIG. 2 illustrates a pair of beams prior to joining and demonstrates the openness of the internal void, which allows inspection of the surface 450 inside the void. FIG. 9 illustrates an alternative embodiment of a beam that utilizes only bottom flanges. FIG. 10 illustrates a pair of alternative embodiment beams that are joined at the bottom flanges. The joined bottom flanges can form a joint 175 and the web has a support surface 155 on which to support a secondary-structure 40, such as, for example, pre-cast slab panels, that can form the internal void 400. One example of a cross-structure supported on a support surface of a web is shown in FIGS. 12C and 12D.

Figure 3A:
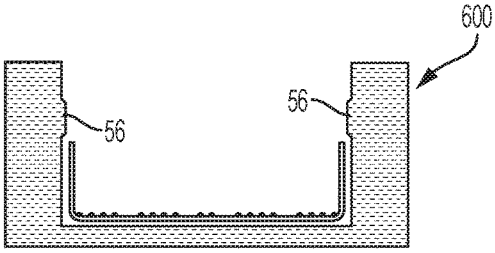
FIG. 3A (PRIOR ART)
FIGS. 3A through 3E (prior art) illustrate a casting method for forming a standard box beam.
Figure 3B:
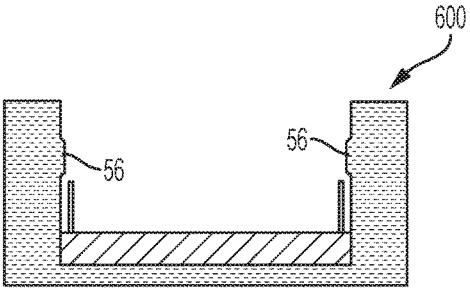
FIG. 3B (PRIOR ART)
Figure 3C:
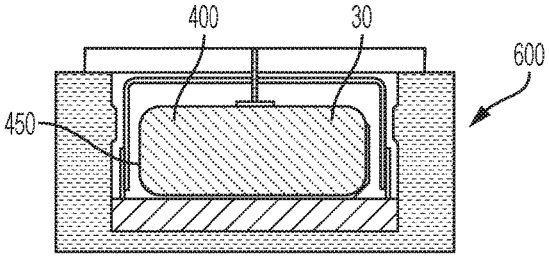
FIG. 3C (PRIOR ART)
Figure 3D:
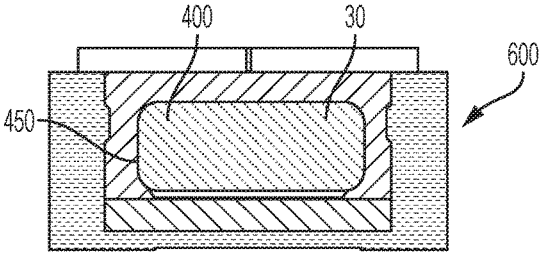
FIG. 3D (PRIOR ART)
Figure 3E:
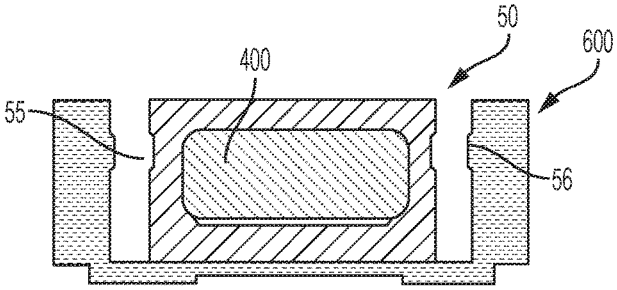
FIG. 3E (PRIOR ART)
Figure 4A:
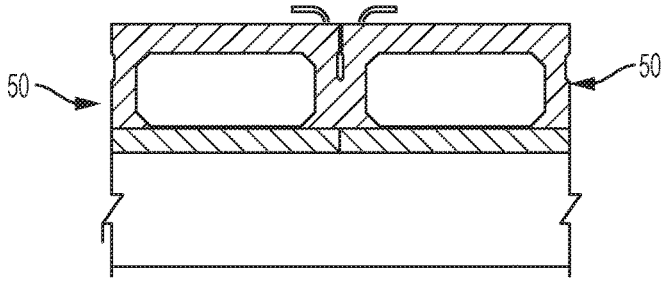
FIG. 4A (PRIOR ART)
FIGS. 4A through 4D (prior art) illustrate a method of joining of two standard box beams.
Figure 4B:
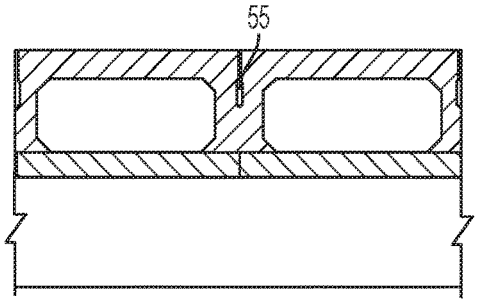
FIG. 4B (PRIOR ART)
Figure 4C:
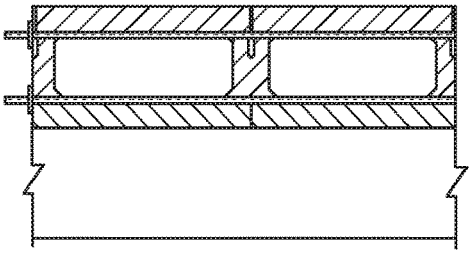
FIG. 4C (PRIOR ART)
Figure 4D:
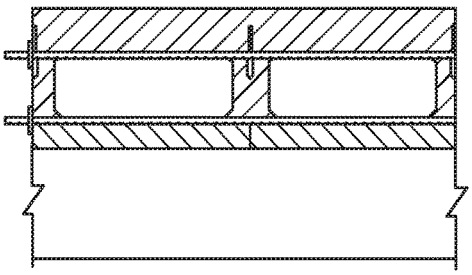
FIG. 4D (PRIOR ART)

The casting of a standard box beam 50 utilizes a box-like framework 600, as shown, for example, in FIGS. 3A-3E. Part of the reinforcement cage is placed in the bottom of the formwork and a layer of concrete or other material is poured over that part of the reinforcement cage, as demonstrated in FIGS. 3A and 3B. A foam "blockout" 30 is placed over the first layer of concrete and held in place with the remainder of the reinforcement cage. Brackets are used to hold down the foam blockout and inhibit it from floating as another layer of concrete is poured around the rest of the reinforcement cage in the framework. Examples of the foam blockout placement and the second pouring of concrete are shown in FIGS. 3C and 3D. FIG. 3E shows the formwork removed from around a final box beam with the foam blockout therein. The foam blockout does not extend to the ends of the beam, i.e. there is an end block of a certain thickness formed of cast concrete over the entire ends of the beam, thereby enclosing the foam blockout within the beam. Post-inspection of the surface is not possible because there is no access to the internal void 400 or the surface of the internal void 450 after the pour is complete.

Certain embodiments of the subject invention provide a beam 100 that can be joined to at least one other beam, which together form, or can be used to form, a structure having an open internal void 400. This provides the advantage of allowing post-inspection of the surface 450 of the internal void. In one embodiment, when two or more beams are joined, the joints 175 formed between them result in a slab surface 750 and under-surface 775. In certain other embodiments, when two or more beams are joined, the joint 175 formed between them provides an undersurface 775. The slab surface and under-surface can be smooth making the slab surface easier to cover over with concrete or asphalt and/or makes the under-surface more aesthetically pleasing.

It can be seen in FIGS. 1 and 9 that embodiments of a beam of the subject invention have a vertical web 150 and at least two bottom flanges 300. In one embodiment, the bottom flanges extend perpendicularly from opposite sides of the bottom end 20 of the web. In another embodiment there are additionally two top flanges 200. In one embodiment, the top flanges extend perpendicularly from opposite sides of the top end 10 of the web. In a further embodiment, one or both of the top flanges are parallel to one or both of the bottom flanges, such as shown, for example in FIG. 1.

In one embodiment, the top flanges 200 and bottom flanges 300 of a beam 100 can be joined to the top flanges and bottom flanges of at least one other beam to create joints 175 between the flanges. The joined beams can have a slab surface 750, under-surface 775, and an internal void 400. The resulting flanges can be joined together utilizing any of a variety of materials, including, but not limited to, the same grout material 35 used to fill the shear key 55 between two standard box beams 50, as discussed above. In a further embodiment, grout material can include Ultra-high performance concrete (UHPC).

In another embodiment, where a beam has only bottom flanges, the bottom flanges 300 can be joined to the bottom flanges of at least one other beam to create a joint 175 between them. The joined beams will form an under-surface 775 and the top end 10 of the web can provide a support surface 155

Irregularities can provide areas or points where grout material 35 can set or harden around or within the irregularities. This can create resistance that inhibits the grout material from being forced out of the space or area between the surfaces. By way of example, the shear key shown in FIG. 3E forms an indentation within the box beam that is wider at one point and narrower above and below. When filled with a grout material, the grout material will form a plug that is wider than the top of the shear key, which can inhibit it from working its way out of the shear key.

To facilitate joining of the flanges between two or more beams, one or more of the flanges can have a profile that is irregular or that is otherwise beneficial for holding the grout material 35 in a joint 175. In one embodiment, a top flange 200 has a profile 250 with one more indentations 257, in which a grout material can foiiii a plug between the profiles of the top flanges. In another embodiment, a bottom flange 300 can have a profile 350 that forms a depression 359 within the bottom end 20, such as shown, for example in FIGS. 1 and 5E. The depression 359 in the bottom end can be filled with a grout material that can also form a plug. One example of this can be seen in FIGS. 6B through 6D. The surfaces of the profiles can also be rough, unfinished, or uneven to further facilitate holding the grout material in place. For example, top flange profile 250, bottom flange profile 350, and support surfaces 155 can be sand-blasted to form a roughened surface, which can aid in adhering to a grout material. A person with skill in the art can detellnine other types of irregularities that can be used on the profiles of top flanges and bottom flanges that are beneficial in securing a grout material in a joint. Such variations are within the scope of this invention.

Figure 7:
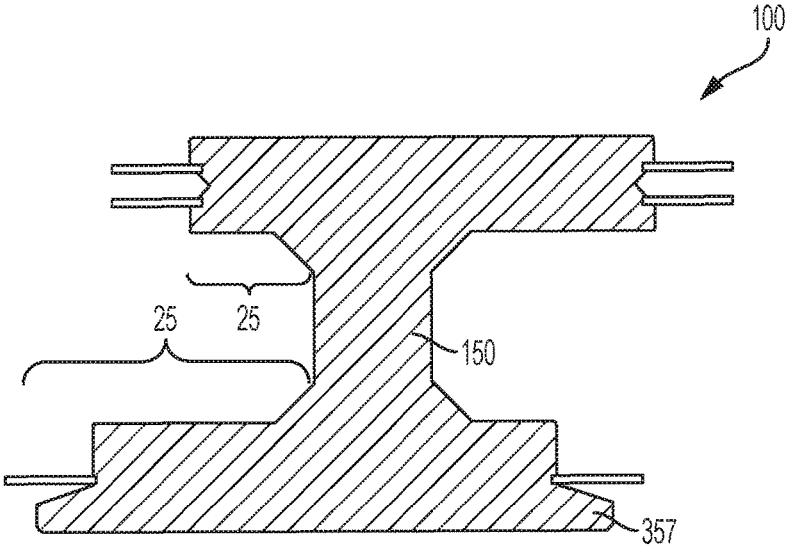
FIG. 7 demonstrates flanges of a beam, according to the subject invention, that have different maximum lengths.
Figure 8:
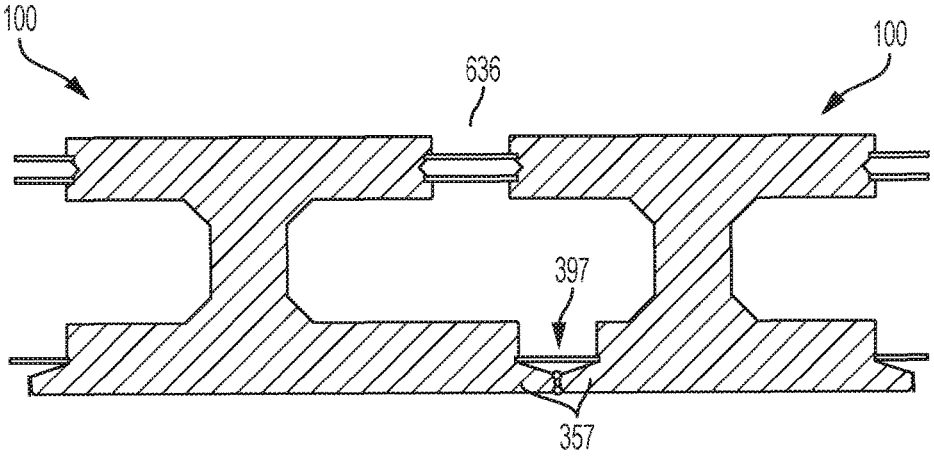
FIG. 8 demonstrates joints between beams that are offset and not vertically aligned.

The length 25 of the top flanges 200 and the length of the bottom flanges 300 can vary, which can change the location of the joints 175 between beams. A maximum length 25 for a flange is the horizontal distance between the vertical web 150 and the end of the profile 250 or 350 of the flange, as shown in FIGS. 1, 2, 7, 8, and 9. In one embodiment, the top flanges and bottom flanges have the same maximum length. In another embodiment, the top flanges have a maximum length that is shorter than the maximum length of the bottom flanges, as shown, for example, in FIGS. 1 and 5E. In yet another embodiment, the top flanges each have a different maximum length. In still another embodiment, the bottom flanges each have a different maximum length. FIGS. 7 and 8 illustrate non-limiting examples of a beam having different length flanges.

The lengths of the flanges can also determine the location of the joints 175 between the flanges of two or more beams. In one embodiment, the maximum lengths can be configured so that the joint between the top flanges and the joint between the bottom flanges is vertically aligned, as shown, for example, in FIGS. 2 and 6D. Alternatively, differing the maximum lengths of the flanges can cause the joints to be offset, such that they are not vertically aligned, an example of which is shown in FIG. 8.

Joining two beams 100 to form a joint can require access to the bottom flanges through a channel 636 formed between the two top flanges. When beams 100 are adjacent, the profiles 350 of the bottom flanges can abut to form a depression 359, as described below. The top flanges can be spaced apart to allow temporary access to the interior void 400. In one embodiment, the length of the top flanges provides a channel 636 that provides access to the interior void when two beams are adjacent. In a more specific embodiment, the combined maximum lengths of the top flanges are less than the combined maximum lengths of the bottom flanges.

Figure 11A:
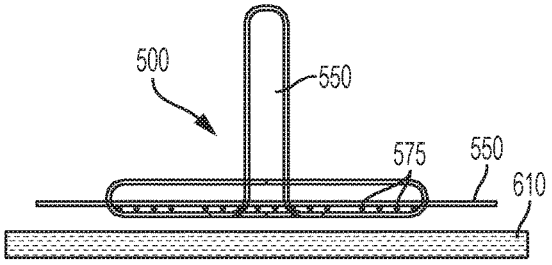
FIGS. 11A through 11E illustrate an embodiment of the casting technique for casting an i-beam, according to the subject invention.

The embodiments of the subject invention can also benefit from the use of reinforcement structures 550 and pre-stressing strands 575. In one embodiment, a modular reinforcement cage 500 is used to reinforce the web and flanges of a beam. A modular reinforcement cage can comprise one or more reinforcement structures, such as, metal rods or formed metal structures, such as shown in FIG. 11A. The modularity of the reinforcement cage allows the components of the cage to be placed individually in the assembled formwork, to reinforce the flanges as well as the web. The reinforcement structures can be placed in a formwork, which can hold their position when the concrete is poured in the framework. Alternatively, one or more of the reinforcement structures can be connected or attached to each other to form a structure capable of maintaining form and position in the formwork when the concrete is poured in the formwork. A modular reinforcement cage can also comprise one or more pre-stressing strands. Advantageously, all of the components of a modular reinforcement cage can be positioned and, if necessary, connected within a formwork before the pouring of concrete. This allows all section of the beam to be reinforced and the concrete to be applied in a single pour, which promotes a more monolithic-type structure and inhibits the formation of cold joints. A person of skill in the art can determine any of a number of configurations for a reinforcement cage. Such variations are within the scope of this invention.

Figure 5A:
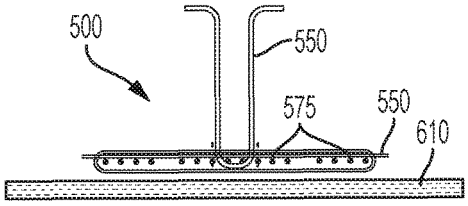
FIGS. 5A through 5E illustrate an embodiment of the casting technique for forming a beam, according to the subject invention.
Figure 5B:
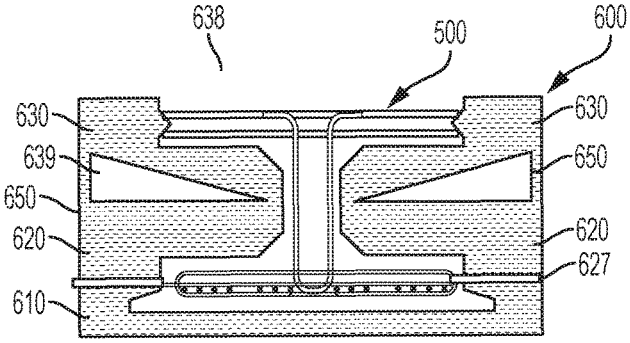
Figure 11B:
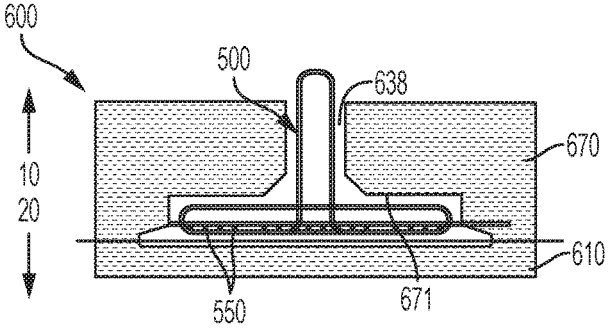

In one embodiment, a modular reinforcement cage 500 has a plurality of reinforcement structures 550, such as, for example, rebar, strategically placed within formwork 600 to support top flanges 200, bottom flanges 300, and the web 150. For example, rebar can be placed lengthwise, or perpendicular to the direction of the maximum length 25, in the bottom end 20 of the formwork to reinforce bottom flanges, as shown in FIGS. 5A and 11A. In a further embodiment, a pre-tensioning strand can be positioned in the formwork, to be pulled in the longitudinal direction of the beam, perpendicular to the maximum length 25, as shown, for example, in FIGS. 5B and 11B. In yet a further embodiment, components of a reinforcement structure can be positioned within the formwork to reinforce the web, as shown in FIGS. 5B and 11B. At least one reinforcing bar can also be placed across the top flanges. In one embodiment, two reinforcing bars are placed across the top flanges.

The formwork in which a beam of the subject invention is cast can be constructed in sections that can be later removed from around a cast beam. This sectional formwork allows the bottom flanges and narrower web to be cast simultaneously to avoid the issue of forming cold joints, wherein softer concrete is poured on set or semi-set concrete. This can also allow the reinforcement cage to be fully assembled in the formwork prior to casting, which, again, can inhibit the formation of cold joints. Self-consolidating concrete (SCC) can also be used for the pour to ensure that the entire formwork, particularly the bottom flanges area, are entirely filled.

FIGS. 5A through 5E illustrate one embodiment of the method for casting a beam that will have both top flanges 200 and bottom flanges 300. FIG. 5A shows a partially assembled reinforcement cage 500 positioned on a formwork base 610. In one embodiment, the formwork is assembled on the base and around the reinforcement cage so that a beam with both top flanges and bottom flanges can be cast. FIGS. 11A through 11E illustrate an alternative embodiment of the method for casting a beam that will have only bottom flanges. FIG. 11A shows a partially assembled reinforcement cage 500 positioned on a formwork base 610. In another embodiment, the formwork is assembled on the base and around the reinforcement cage so that a beam with only bottom flanges can be cast.

Figure 5C:
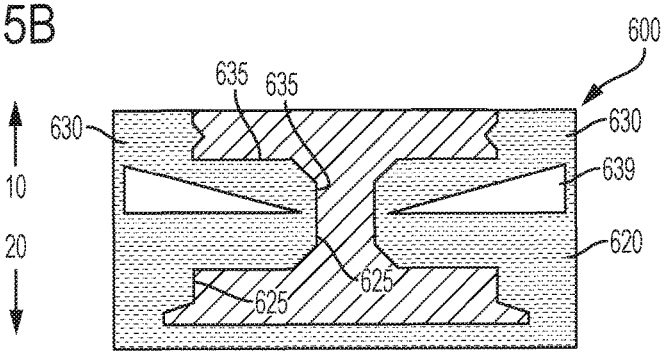
Figure 5D:
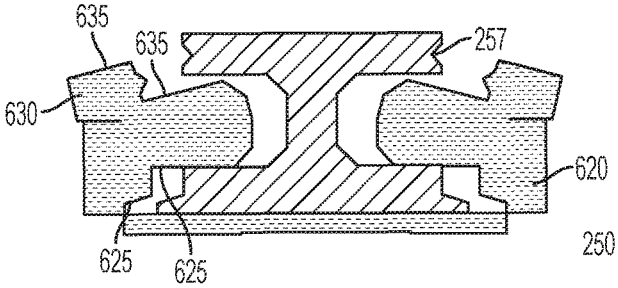
Figure 5E:
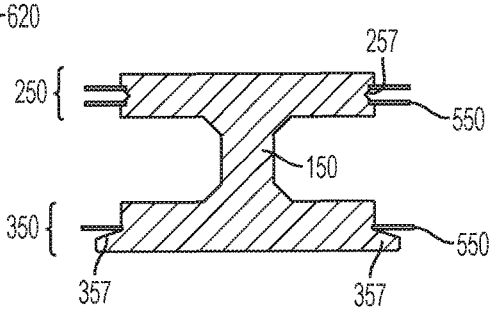
Figure 11C:
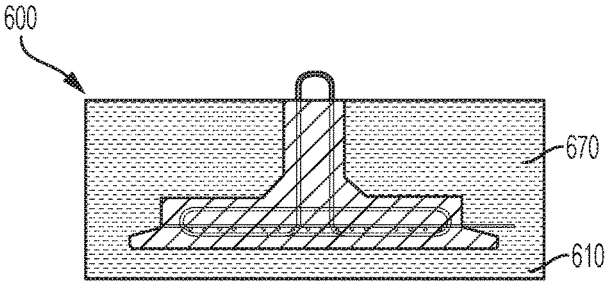
Figure 11D:
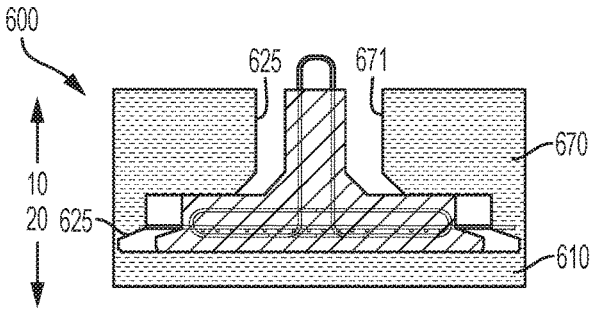
Figure 11E:
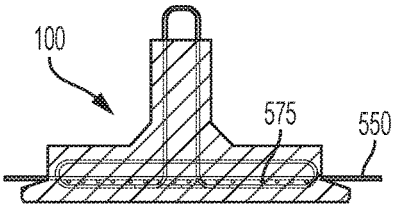

In one embodiment, a pair of under-molds 620 is positioned on either side of the base. Each under-mold has a mold face 625 that can forni a bottom flange, bottom flange profile, and part of the web, as shown in FIGS. 5B, 5C, and 5D. In one embodiment, the under-molds can encompass a lower portion of the reinforcement cage 500 that includes part of the reinforcement cage that will be in the web 150. In an alternative embodiment, where the beam will not include top flanges, the under-mold can form a bottom flange, bottom flange profile, and the entire web, such as shown for example in FIG. 11B. The under-mold can also form a formwork port 638 through which concrete can be poured into the mold, as illustrated, by way of example, in FIG. 11B In a further embodiment, a pair of upper-molds 630 can be positioned above and adjacent to each of the under-molds. Each upper-mold has a mold face 635 that can form a top flange, a top flange profile, and the remaining top part of the web that is not formed by the under-mold. The upper-mold face can also provide a formwork port 638 on the top end 10 through which concrete can be poured into the mold. FIGS. 5B, 5C and 5D illustrate an example of an upper-mold. As seen in these Figures, the upper-molds can encompass an upper portion of the reinforcement cage. The remaining portion of the reinforcement cage can be put in place after the upper-mold is positioned. In one embodiment, the upper-mold can include one or more ducts 637 through which pre-tensioning strands 575 can be pulledln yet a further embodiment, an under-mold 620 and an upper-mold 630 can be configured so that when they are positioned adjacently on the base, there is a space or wedge-shaped gap 639 between them, in which a spacer 650 can be inserted. The spacer can hold the upper-mold and under-mold in the proper position or alignment and hold open the gap. After the concrete is cast in the mold and sets, the spacer can be removed. The gap can then close and provide the necessary space to "break" or separate the under-mold and upper-mold from around the beam, as demonstrated, for example, in FIGS. 5D and 5E. In an alternative embodiment, the under-mold 620 and upper-mold can be replaced with a unitary mold piece 670. A unitary mold piece can have a profile 671 that forms flanges, such as bottom flanges, and the web, as shown in FIGS. 11B through 11D. After casting, the unitary mold piece can be separated by moving or pulling in a horizontal direction away from the beam, as shown, for example, in FIG. 11D. A person of skill in the art can determine any of a number of configurations for formwork for these beams. Such variations in formwork design are within the scope of this invention.

When placed side-by side, box beams have a space between them called a "shear key" 55. The shear key is filled with grout material, for example, magnesium ammonium phosphate grout mixed with pea gravel, polymer cements, fiber-reinforced cements, and epoxy-based grouts. Ultra-high performance concrete (UHPC) can also be an advantageous grout material as it is less susceptible to cracking and more efficient to use, usually hardening in a few days.

Regardless of the grout material used, the shear key between box beams is a recognized weak point in box beam structures. Many grout materials are susceptible to longitudinal cracks that allow ingress of water and other chemicals between the box beams and into the concrete. This can create a moist environment between the box beams that can corrode the reinforcement cage, spall the concrete, and generally limit the lifespan of the structure. Many studies have been done in an effort to understand and find ways to prevent cracks in the grout material and/or inhibit the damage done by water and other chemicals.

The embodiments of the subject invention are advantageous because they can provide an alternative to the standard shear key configuration and provide a method for joining beams that can minimize the damage caused by water or chemicals that may seep past the grout material. As described above, the top flanges 200 and the bottom flanges 300 can have profiles, 250 and 350, respectively, that are shaped to hold grout material in place between the flanges. The subject invention also provides unique methods for filling the space between the flanges. Furthermore, the location of the joints 175 allows water and other materials to flow into the internal voids 400 allowing it to drain out of the open ends 9 in the beam. The joint between the bottom flanges can be formed before the joint between the top flanges. This is facilitated by a channel 636 that is formed between the top flanges when the beams are adjacent. While the bottom flanges can abut, as described above, the top flanges can be spaced apart, forming a channel that provides access to the interior void 400 and the depression 359 in the bottom end.

In one embodiment, the bottom flange 300 of a beam 100 is molded with a ridge 357 that extends out from the profile 350. When two beams are placed adjacent, with their profiles facing each other, the ridges can form a depression 359 within the bottom end of the interior void 400, such as shown, for example, in FIGS. 2 and 12A. In one embodiment, the depression can be filled with grout material or UHPC 35 to join the bottom flanges and form a joint 175.

Figure 6A:
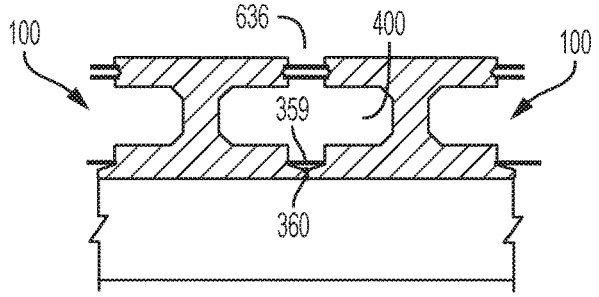
FIGS. 6A through 6D illustrate a method for joining two 1-beams, according to the subject invention.
Figure 6B:
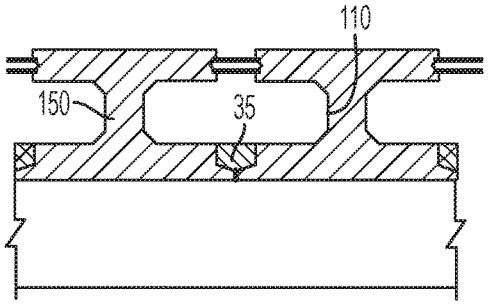
Figure 6C:
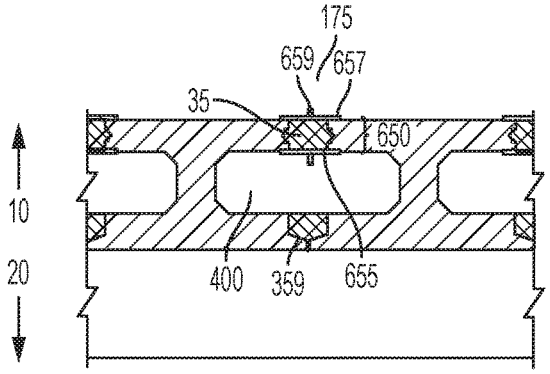
Figure 6D:
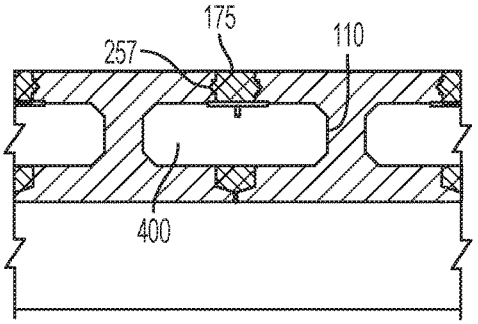

In a further embodiment, the ridge can be formed so that the bottom end 20 of the depression is lower than the sides of the depression. FIGS. 6A and 12A illustrate a non-limiting example of a depression with a bottom end lower than the sides. In a more specific embodiment, the depression forms an apex 358 where the flanges meet giving the depression a V-shape, as shown, for example, in FIG. 12A. When filled, there will be more grout material, such as, for example, UHPC, over the apex pushing down to form a seal between the flanges. In a yet further embodiment, a backing 360 can be disposed in the depression to cover at least part of the depression where the ridges meet, prior to being filled with grout material like UHPC. A backing can be any structure or material placed over or in the depression, particularly where the flanges meet, prior to filling with grout like UHPC. By way of example, backing can be a sheet material or tubular material that sits in and lines the depression. Alternatively, the backing can be a material that is applied to the bottom end of the depression, for example putties, pastes, adhesives, or other types of materials can be applied to the depression prior to filling with grout material like UHPC. FIGS. 2, 6A, 10, and 12A illustrate examples of a backing 360 in a depression 359. In a specific embodiment, the backing material is a backer rod disposed within the apex 358. The depression can be filled with grout material like UHPC over the backer rod.

After the joint between the bottom flanges is formed, the space or channel 636 between the top flanges 200 can be closed or filled. The method for closing the channel depends upon whether the beam has top flanges 20 or if the beam supports secondary-structures 40, such as slab panels for example, on the web 150. Both methods will result in closure of the channel and formation of an open interior void accessible from either open end 110.

FIGS. 6A through 6D illustrate an embodiment of a method for closing the channel 636 and forming a joint 175 between the top flanges 200 of two or more beams 100. In one embodiment, a joint formwork 650 is used to enclose grout material like UHPC in the channel 636. A joint formwork can have an inside mold 655 and an outside mold 657. The inside mold can press against the top end 10 of the internal void 400 to form a type of shear pocket 160 between the inside mold and the profiles 250 of the adjacent top flanges. A connector 659 can be attached to the inside mold and extend out of the top end 10 of the shear pocket 160. The shear pocket can be filled with grout material like UHPC 35 around the connector. An outside mold can be operably attached to the connector so that the outside mold pushes against the slab surface 750. When the inside mold and outside mold are secured with the connector, grout material or UHPC is enclosed between the profiles 250 and can harden or set in place. The outside mold 657 can then be removed and asphalt or other cover material can then be applied over the joint.

FIGS. 12A through 12D illustrate a non-limiting example of a method for closing the channel 636 and forming a joint 175 with beams that support secondary-structures 40 on the web 150. In one embodiment, secondary-structures are positioned on the top end 10 of the web, forming an alternative type of shear pocket 160 between the top end of the web and the secondary-structures. In a further embodiment, the shear pocket is filled with grout like UHPC. FIG. 12D illustrates an example of a filled shear pocket. In a further embodiment, when the reinforcement cage is constructed in the formwork, a portion thereof can be raised above the level of the support surface. This raised portion can reinforce the grout material like UHPC when the shear key is filled, which is shown, by way of example, in FIG. 12D. This raised portion of reinforcement also creates a composite connection between the beam and the precast slab 40. Asphalt or other cover material can then be applied over the grouted in shear keys and the secondary-structure.

Pre-stressed concrete box beams have been used to construct short- to mid-span bridges for decades. They provide a fast, economical way to construct bridges. The structure of a box beam has the disadvantage of having a closed internal void that inhibits full post-cast inspection of the box beam and complete inspection of any structures built therewith. Box beams are installed adjacently with a shear key between them that is filled with grout material to inhibit water seepage between the box beams. This presents a further disadvantage because the grout material is susceptible to longitudinal cracking, which allows ingress of water and other materials between the box beams. This promotes deterioration of the box beams and shortens the lifespan of the overall structure. The subject invention provides a viable alternative to the use of standard box beams. The beam embodiments of the subject invention, when installed, provide a structure similar to a box beam, but without a closed internal void. Embodiments of the subject invention also inhibit moisture from being retained between the beams, by having joints that open into the internal void, which allows water to be more easily dissipated.

Any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

What is claimed is:

1. A concrete beam comprising:

a web having a top end and a bottom end;

a support surface at the top end of the web having a length;

one or more bottom flanges, each having a a ridge, that extend from the bottom end of the web, each of the one or more bottom flanges having a maximum length that is greater than the length of the support surface, a modular reinforcement cage comprising connectable components embedded in the web and the one or more bottom flanges;

wherein a first concrete beam with the ridge abutting the ridge of a second concrete beam forms a depression, adapted to contain grout material, for joining the bottom flanges.

2. A beam, according to claim 1, further comprising one or more top flanges that extend from the top end of the web and are parallel to the one or more bottom flanges, the one or more top flanges having a maximum length that is less than the maximum length of said one or more bottom flanges, such that when the ridge of the first concrete beam is abutting to the ridge of the second concrete beam there is a channel between the top flanges.

3. A beam, according to claim 2, further comprising a joint formwork operably connectable between one of said one or more top flanges of the first concrete beam and one of said one or more top flange of the second concrete beam, the joint formwork being adapted to enclose grout material in the channel to join the top flanges, thereby forming an internal void between the concrete beams.

4. A beam, according to claim 1, wherein the support surface is adapted to support a secondary structure between the first beam and the second beam, such that an enclosed internal void is formed between the beams and the secondary structure.

5. A method for constructing superstructure utilizing two or more beams, wherein each beam comprises:

a web having a top end and a bottom end;

a support surface at the top end of the web having a length;

two or more flanges, each having a ridge, extending from opposite sides of the bottom end of the web and having a maximum length that is greater than the length of the support surface;

wherein the method comprises;

positioning the two or more beams with the ridges of the flanges abutting one another to form a depression, and utilizing the depression, adapted to receive a grout material to form a joint that connects the adjacent flanges the beam further comprising one or more top flanges that extend from the top end of the web, one of said one or more top flanges being parallel to one of said one or more bottom flanges and having a maximum length that is less than the maximum length of the one or more bottom flanges, wherein the method further comprises:

utilizing a joint formwork to connect the top flanges of the two or more side-by-side beams, which comprises, positioning an inside mold between and against two connected top flanges to form a shear key adapted to receive the grout material;

attaching a connector to the inside mold that extends through the shear key;

filling the shear key with the grout material;

connecting an outside mold to the connector so that the outside mold is against the connected top flanges and over the shear key, thereby containing the grout material within the shear key such that an internal void is formed between the two beams.

6. The method, according to claim 5, wherein the depression is further adapted to receive a backing material, the method further comprising placing the backing material in the depression between or against the ridges.

7. A concrete beam, adapted for use in superstructure, comprising:

a web having a top end and a bottom end;

one or more bottom flanges, each having a ridge, extending from opposite sides of the bottom end of the web and each having a maximum length, one or more top flanges that extend from opposite sides of the top end of the web, parallel to the one or more bottom flanges, each top flange having a maximum length that is less than the maximum length one of said one or more bottom flanges;

a reinforcement cage embedded within the beam;

such that the one or more bottom flanges and the one or more top flanges of a first beam are joined to the one or more bottom flanges and the one or more top flanges of a second beam, to provide an open internal void between the joined flanges and the webs.

8. The concrete beam, according to claim 7, wherein joining the bottom flanges includes positioning the ridge of a bottom flange of the first beam abutting the ridge of the bottom flange of the second beam, thereby forming a depression between the bottom flanges and a channel between the top flanges of the first beam and the top flange of the second beam.

9. The concrete beam, according to claim 8, wherein the depression and the channel are adapted to receive a grout material to join the concrete beams.

* * * * *